United States Patent [19]

Kraeutler

[11] Patent Number: 4,776,379

[45] Date of Patent: Oct. 11, 1988

[54] RISER FOR A VERTICALLY-OPENING DOOR

[75] Inventor: Bernard Kraeutler, Dunieres, France

[73] Assignee: Nergeco, Dunieres, France

[21] Appl. No.: 911,687

[22] Filed: Sep. 25, 1986

[30] Foreign Application Priority Data

Sep. 25, 1985 [FR] France ..... 85 14172

[51] Int. Cl.[4] ..... E06B 3/94

[52] U.S. Cl. ..... 160/84.1; 160/271

[58] Field of Search ..... 160/84 R, 268 R, 270, 160/271, 272, 273 R; 219/201, 213, 218

[56] References Cited

U.S. PATENT DOCUMENTS

| | | | |
|---|---|---|---|
| 2,731,804 | 1/1956 | Grubbs | 219/218 X |
| 2,858,408 | 10/1958 | Barroero | 219/218 X |
| 3,697,723 | 10/1972 | Winsler et al. | 219/218 |
| 4,194,549 | 3/1980 | Lövgren | 160/84 R |
| 4,397,347 | 8/1983 | Brabant | 160/84 R X |

*Primary Examiner*—Ramon S. Britts
*Assistant Examiner*—David M. Purol
*Attorney, Agent, or Firm*—Sughrue, Mion, Zinn, Macpeak, and Seas

[57] ABSTRACT

A vertically-opening door installation which is exposed to cold on one side includes a vertically-opening flexible curtain (6) and two risers to guide the respective side edge of the curtain. Each riser includes a lining (12) made of a material which is a poor conductor of heat and which lines the inside of the channel section bar, and at least one longitudinally-extending cavity (14) providing a cushion of air between the outside surface of the channel section bar and the inside surface of its lining. The inside surface of lining (12) is smooth. At least one of the longitudinally-extending cavities (14) may include electrical heater resistance (15) or similar heating devices. The riser is provided to prevent frost and ice from forming around the side edges of the curtain of a goods-handling door which is exposed to the cold.

13 Claims, 3 Drawing Sheets

RISER FOR A VERTICALLY-OPENING DOOR

The present invention relates to a riser for a verticallyopening door, e.g. a flexible curtain-type door.

BACKGROUND OF THE INVENTION

Vertically-opening goods-handling doors are commonly provided on industrial premises and warehouses for opening and closing many time a day. In most cases, it is important to reduce heat exchange between the inside and the outside, and rapid-acting systems are therefore provided. In practice, such systems can only be provided for relatively light curtain doors, i.e. doors which do not require large actuation forces. Thus, present doors of this type, regardless of whether they are doors of the concertina type or doors of the type wound onto a shaft (which shaft may be placed at the top or bottom of the curtain), comprise a flexible curtain which may optionally be stiffened at regular intervals by reinforcing bars. In the following description, a concertina-type door is used as an example for describing the invention, however it must naturally be understood that the invention is applicable to any vertically-opening door performing a similar function.

In a particular prior art embodiment of a concertina-type door, there are:

two channel-section metal risers having their top ends interconnected by a beam which supports drive means essentially constituted by a motor and a shaft for winding up door-raising straps;

a flexible curtain which is stiffened at regular intervals by horizontal reinforcing bars; and lifting straps which are fixed at one end to the bottom reinforcing bar of the flexible curtain and at the other end to the shaft onto which they are wound when the shaft is driven by the motor.

Preferably, the lifting straps pass through guides disposed on at least some of the reinforcing bars. Some of the reinforcing bars, including the bottom bar, have guide wheels disposed at each end for guiding the sides of the curtain along the channel-section risers while protecting said edges from wear which would arise from their coming directly into contact with said risers.

In order to prevent drafts flowing round the sides of the flexible curtain as guided by the risers, various solutions have been suggested in the past. One of these solutions is described in Nergeco's French patent application number 85/02826 and consists in providing the concertina-type door with moving sealing members fixed to the sides of the flexible curtain. In said patent application, the flexible curtain includes respective strips of flexible material mounted on each of its side edges and pressing against the webs of channelsection risers, said strips extending beyond the longitudinal extent of the guide wheels. Such strips may be made of rubber including optional transverse notches, or else by a stack of at least two such notched strips with the notches being offset relative to each other, or else by a brush having long and flexible bristles, or by the side edges of the curtain itself, which edges are made too long specifically for this purpose, or finally by any other flexible material in any suitable form for providing the same draft-excluding function.

The draft-excluding strips described in the above-mentioned patent application are highly effective, however they are vulnerable in two different ways. Firstly by sliding in direct contact with the channel-section risers which are generally made of fairly rough metal, they suffer rather rapid wear. Secondly, when fitted to doors that are exposed to fairly intense cold on one of their faces, they frequently become stuck to the metal risers by frost. When a concertinatype door fitted with side draft-excluding strips such as those described above is used for separating two volumes having ambient temperatures respectively above and below 0° C., for example a door to a deep-freeze warehouse opening to the outside, or opening to premises where the ambient temperature is greater than 0° C., it has been observed that ice forms in the risers between the draft-excluding strips and said risers. The ice jams the reinforcing bars of the curtain together with the guide wheels fixed thereto and sticks the draft-excluding strips to the risers, thereby preventing the curtain from operating. This prevents the concertina-type door from opening or closing. This is due to water vapor migrating between the two spaces, and in particular to water vapor entering the space at less than 0° C. from the space where the ambient temperature is greater than 0° C. As a result the water vapor condenses on the risers and on the draft-excluding strips and is then transformed into ice on those portions thereof which are at a temperature below freezing.

Preferred embodiments of the present invention mitigate these drawbacks.

SUMMARY OF THE INVENTION

The present invention provides a riser for a verticallyopening door including a vertically-deployed flexible curtain, said riser serving to guide the side edges of said curtain and comprising a metal channel-section bar, a lining of a material which is a poor conductor of heat disposed inside said channel section, and at least one longitudinally-extending cavity forming a cushion of air between the inside surface of said channel section bar and the outside surface of said lining.

Preferably, such risers are provided with heater means for maintaining those portions thereof which are in contact with the edges of a curtain and with the draft-excluding strip fixed thereto at a temperature greater than freezing. Such heater means may be constituted by electrical resistances placed inside the riser or incorporated in the riser. When the door is used with a low-temperature warehouse, the air contained in the cavities of the riser may, for example, be heated by the warehouse refrigerator means, for example its compressors or its batteries of heat exchangers.

MORE DETAILED DESCRIPTION

Figure 1:
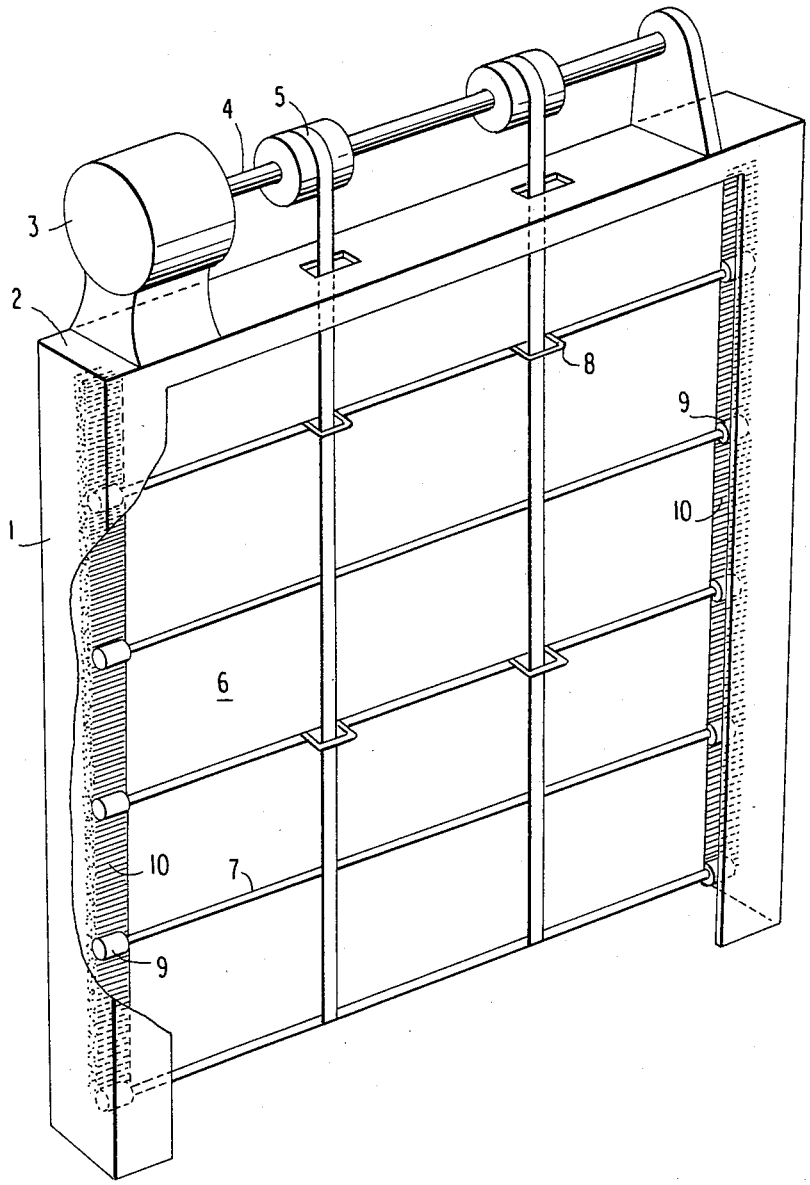
FIG. 1 PRIOR ART
FIG. 1 is a partially cutaway diagrammatic perspective view of a prior art concertina-type door whose curtain includes lateral draft-excluder strips.

FIG. 1 shows the main components of a conventional concertina-type door:

two channel section bars constituting vertical risers 1 and forming lateral guides;

a cross-beam 2 supported on the top ends of the risers and supporting a motor 3 for driving a shaft 4 for winding up lifting straps;

a flexible curtain 6 which is stiffened at regular intervals by reinforcing bars 7;

lifting straps 5 having their bottom ends fixed to the bottom reinforcing bar of the flexible curtain and having their top ends fixed to the winding shaft 4;

guides 8 for the lifting straps 5 and fixed on some of the reinforcing bars 7; and guide wheels 9 fixed to the ends of the reinforcing bars 7.

The concertina-type door shown in FIG. 1 also includes a draft-excluding member in the form of two draft-excluding strips 10 fixed to respective ones of the side edges of the flexible curtains. Each of these draft-excluding strips is constituted by a brush of flexible bristles which are long enough to come into contact with the web at the bottom of the corresponding riser 1. The brushes 10 extend sideways beyond the guide wheels 9.

FIGS. 2 to 6 show various embodiments of risers 1 suitable for equipping a concertina-type door of the kind described above (and more generally, suitable for equipping any vertically-opening door which requires such risers).

Figure 2:
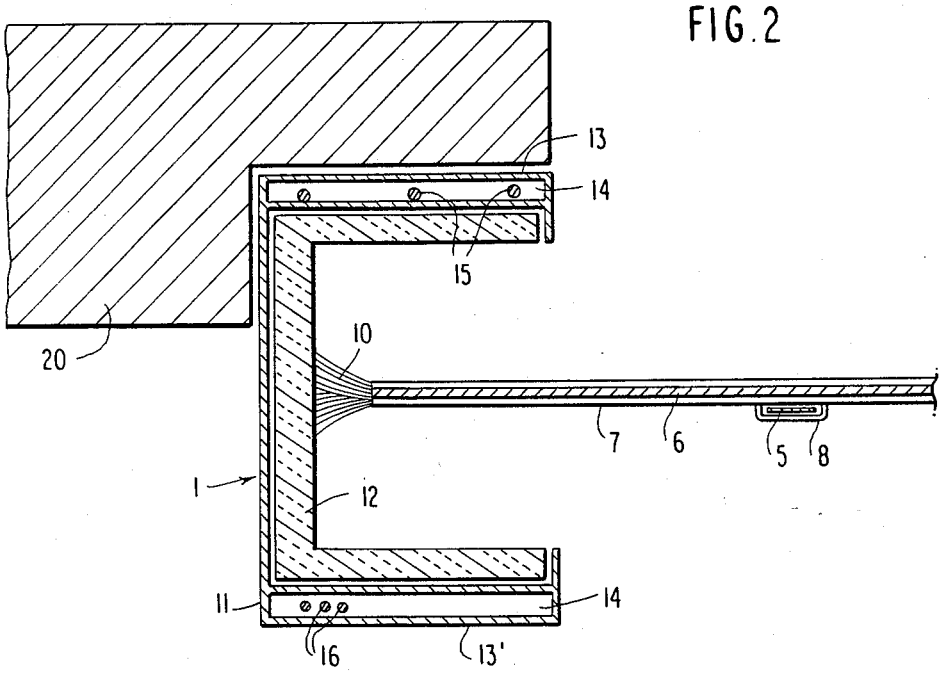
FIGS. 2 to 6 are diagrammatic fragmentary sections on a horizontal plane through five embodiments of risers in accordance with the present invention.

The riser 1 shown in FIG. 2 is half built into a wall 20. It comprises a metal channel section bar 11 which is lined on the inside with lining 12 made of thermally insulating material. The flanges 13 and 13' of the bar 11 are each double-walled, thereby delimiting cavities 14 running along the full height of the riser. Each of the cavities 14 contains a cushion of air. Means are provided for heating at least that one of the two air cushions which is closest to the side of the door which is exposed to the cold. Thus, the effect of a thermal bridge between the flanges 13 and 13' which are exposed to very different temperatures is at least partially counteracted. The cold side cavity may be heated by any suitable means, for example by heating resistances 15 or by a flow of hot air. If the door is disposed at the entrance to refrigerated premises, the heat may be taken from the compressors of the cooling equipment. Advantageously, the cavities 14 may also be used as ducts for passing and protecting the electrical cables 16 for powering the motor driving the strap-winding shaft. In a variant of this type of riser (not shown), only one of the flanges 13 and 13' of the channel section bar 11 needs to have a double wall. When the door is installed, the flange in each riser having the double wall and therefore capable of receiving the heater means 15 must then be disposed on the side of the door which is exposed to the cold.

The lining 12 inside the bar 11 provides a thermal effect which is complementary to that provided by the cushion of hot air enclosed in at least one of the riser flanges 13 and 13'. This lining serves to completely avoid the thermal bridge effects between the flanges exposed to differing temperatures. Advantageously, the lining is made of polyurethane foam which has been subjected to surface treatment in order to provide it with an envelope which is rigid or semi-rigid. Depending on the material from which it is made, the thickness of the lining should be between about half a centimeter and about four centimeters. It is fixed to the channel section bar 11 by any suitable means, for example by gluing.

The lining 12 also serves to limit wear on the side edges of the curtain 6 and also to limit wear on the draft-excluding strips 10 fixed thereto (constituted in FIG. 2 by a brush of long, flexible bristles). To this end, the inside wall of the lining 12 is treated so as to be smooth. Thus, it may be possible to omit guide wheels 9 from the ends of the reinforcing bars 7 since the purpose of the guide wheels is specifically to reduce friction between the edges of the curtain and the parallel faces of the riser flanges, which are generally fairly rough.

Figure 3:
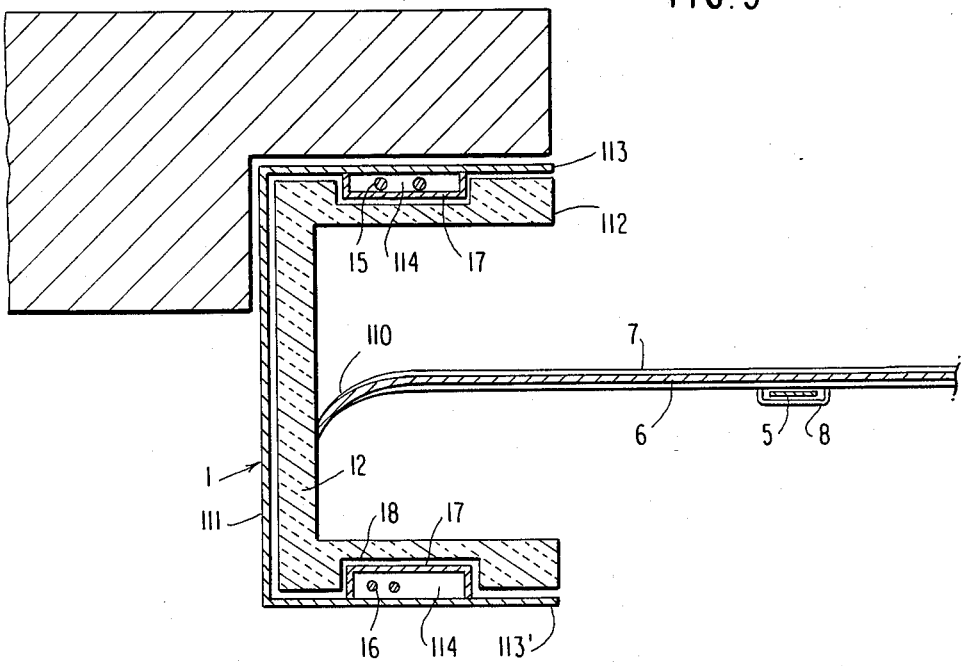

FIG. 3 shows a second embodiment of a riser 1 in accordance with the invention. This riser differs from the above-described riser in that the flanges 113 and 113' of its channel section metal bar 111 do not include a double wall. Metal chutes 17 are welded to the inside faces of said flanges and delimit cavities 114 inside which heater means 15 and/or cables 16 may be disposed as described above with reference to FIG. 2. The lining 112 is identical to that shown in FIG. 2 except that it includes a longitudinal groove 18 in each of its outer parallel faces in order to receive the chutes 17. It may be observed that the draft-excluder member 110 shown in this figure is constituted by an extension of the side edge of the curtain itself. In a variant (not shown) of this type of riser, only one of the flanges 113 and 113' of the channel section bar 111 includes a chute 17. When the door is installed, the flange with the chute 17 suitable for receiving heater means 15 must be placed on the cold side of the door.

Figure 4A:
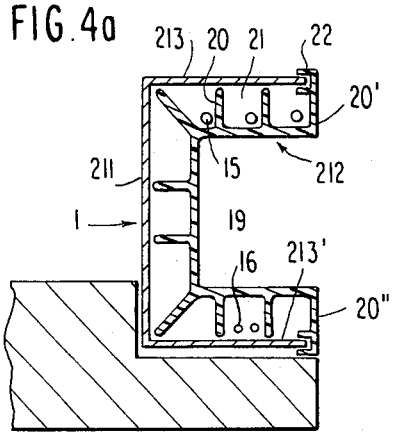
Figure 4B:
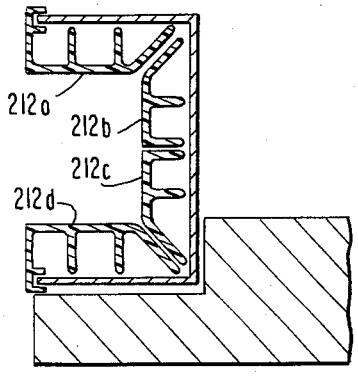

FIGS. 4*a* and 4*b* show two variants of a third embodiment of a riser 1 in accordance with the invention. The riser 1 comprises a conventional metal channel section bar 211 which is lined on the inside with a lining 212. The lining 212 is made of a material which is a poor conductor of heat and which is rigid or semi-rigid. It comprises a channel section portion 19 having spacers 20 projecting outwardly from its outside face and intended to hold the channel-section portion 19 at a fixed distance from the channel section bar 211 while simultaneously delimiting a series of cavities 21 which enclose respective columns of air. The channel section portion 19 and the spacers 20 projecting therefrom are advantageously obtained by molding or by extruding a plastic material such as PVC. These parts may be from three to ten millimeters thick depending on the nature of the material used and on the height of the riser 1. Advantageously, the spacers 20' and 20" enclosing cavities 21 situated adjacent to the edges of the channel section bar 211 further include parallel lips 22 for clamping on the edges of the flanges of the channel section bar. The lining 212 may be made as a single piece (see FIG. 4*a*) or as a plurality of assembled pieces (four pieces shown in 4*b*) of generally trapezoidal cross-section. Advantageously, the parts 212*a*, 212*b*, 212*a*, 212*b*, are held in position relative to one another by a rapid fixing system.

As in the above-described embodiments, at least one of the cavities 21 may include heater means 15 and at least one of the cavities may serve as a duct for cables 16.

Figure 5A:
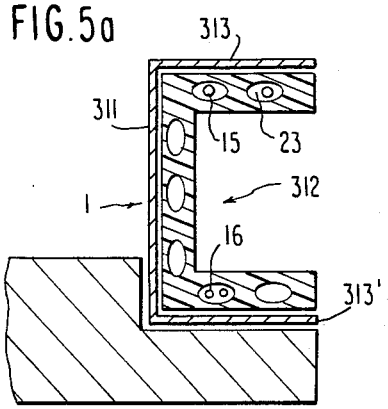
Figure 5B:
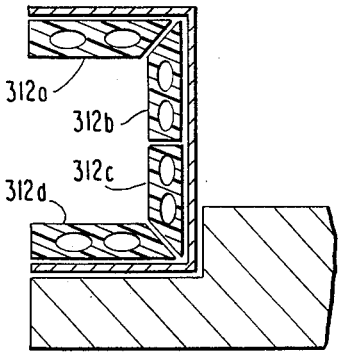
Figure 6A:
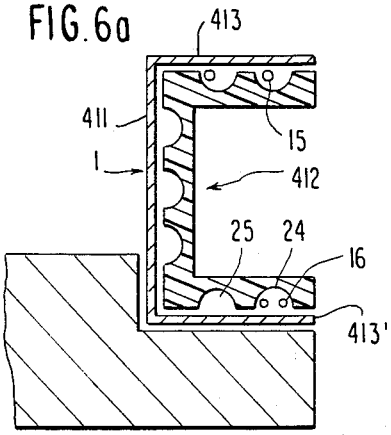
Figure 6B:
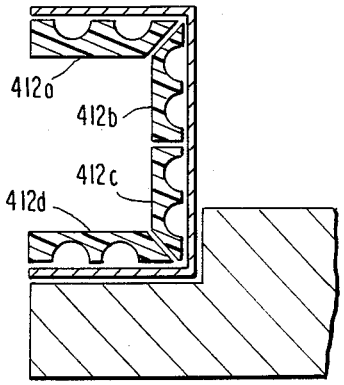

The risers 1 shown in FIGS. 5 and 6 are each constituted by a conventional channel section metal bar 311, 411 lined with an inside lining 312, 412. In each case the lining 312, 412 is made of a material which is a poor conductor of heat and which includes longitudinally extending inside cavities 23 (FIG. 5), or longitudinally-extending grooves 24 (FIG. 6) in the outside surface thereof for defining longitudinally-extending cavities 25 against the bar 411. In either case, the cavities 23 and 25 enclose a cushion of air capable of being heated by electric heater resistances 15 or by receiving of flow of hot air. The cavities 23 or 25 may also be used as ducts for the cables 16. Advantageously, the linings 312, 412 shown in FIGS. 5 and 6 are made of polyurethane foam and are subjected to surface treatment to provide an envelope which is rigid or semi-rigid. Alternatively, the linings 312, 412 may be made of polyurethane foam which is covered with an envelope of rigid or semi-rigid plastic material such as PVC. In either case, the thickness of the linings lies in the range one to four centimeters. The linings may be made as a single piece (FIGS. 5*a* and 6*a*) or as a plurality of pieces of generally trapezoidal cross-section 312*a*, 312*b*, 312*c*, 312*d* (FIG. 5*b*) and 412*a*, 412*b*, 412*c*, 412*d* (FIG. 6*b*).

The advantage of the linings 212, 312, 412 shown in FIGS. 4 to 6 is that they are capable of being mounted, where necessary, on risers constituted by conventional channel-section bars, which means that they may be added to equipment not originally intended to receive them. Naturally, these linings retain the advantages described above with reference to the risers shown in FIGS. 2 and 3.

Thus, risers in accordance with the invention possess numerous advantages over the prior art, and in particular, they possess the following advantages:

thermal bridges arising from the temperature difference between the flanges of the metal channel section bar at different temperatures are substantially eliminated. The necessary conditions for the formation of frost and ice inside the door risers are no long satisfied;

friction is substantially reduced by establishing smooth surfaces, thereby greatly reducing wear on the edges of the curtain and on the draft-excluder strips fixed thereto; and the cost of doors is reduced since the now unnecessary guide wheels are omitted.

The present invention is not limited to the embodiments described above, and it applies to any modification or variant which may occur to the person skilled in the art and which falls within the claims.

I claim:

1. A vertically-opening door installation, comprising:

(a) a vertically-extending flexible curtain, and (b) a pair of vertical risers flanking the curtain and disposed to engage and guide the side edges of said curtain, each riser comprising:

(c) a generally U-shaped metal channel section bar having two spaced, parallel flanges;

(d) a generally U-shaped lining made of a material which is a poor conductor of heat and lining inwardly facing surfaces of said bar; and (e) at least one longitudinally-extending cavity forming a cushion of air between an inwardly facing surface of one of said flanges and an outwardly facing surface of said lining, (f) said lining serving to substantially eliminate any thermal bridge between the flanges due to different temperatures thereof, (g) wherein at least one of the longitudinal cavities includes heater means.

2. A door installation according to claim 1, wherein the inside surface of the lining is smooth to reduce wear on the side edges of the curtain.

3. A door installation according to claim 1, wherein the heater means are constituted by electrical resistances.

4. A door installation according to claim 1, wherein at least one of said longitudinally-extending cavities serves as a duct for passing and protecting electric cables (16).

5. A door installation according to claim 1, wherein at least one of the flanges of the channel section bar includes a double wall defining longitudinally-extending cavity.

6. A door installation according to claim 1, wherein the channel section bar includes at least one chute (17) fixed to the inside surface of at least one of its flanges to define a longitudinally-extending cavity.

7. A door installation according to claim 1, wherein the lining includes longitudinally-extending cavities (23) disposed in the thickness of said lining.

8. A door installation according to claim 1, wherein the lining includes longitudinally-extending grooves (24) in its outside face defining longitudinally-extending air-containing cavities (25) in cooperation with the inside surface of the channel section bar.

9. A door installation according to claim 1, wherein the lining is made of surface-hardened polyurethane foam.

10. A door installation according to claim 1, wherein the lining is made of polyurethane foam covered with an envelope of rigid plastic material.

11. A door installation according to claim 1, wherein the lining comprises a channel section portion (19) together with longitudinally-extending and outwardly-projecting spacers (20) for holding the channel section portion relative to the channel section bar and for defining columns of air (21) in cooperation therewith.

12. A riser according to claim 11, wherein the lining is made of PVC.

13. A riser according to claim 1, wherein the lining is glued to the channel section bar.

* * * * *